US009297174B2

(12) United States Patent
Ventling

(10) Patent No.: US 9,297,174 B2
(45) Date of Patent: Mar. 29, 2016

(54) TRUSS-WALL INSTALLATION SYSTEM AND RELATED METHODS

(71) Applicant: Steve Ventling, Billings, MT (US)

(72) Inventor: Steve Ventling, Billings, MT (US)

( * ) Notice: Subject to any disclaimer, the term of this patent is extended or adjusted under 35 U.S.C. 154(b) by 0 days.

(21) Appl. No.: 14/210,737

(22) Filed: Mar. 14, 2014

(65) Prior Publication Data

US 2014/0305067 A1 Oct. 16, 2014

Related U.S. Application Data

(60) Provisional application No. 61/781,765, filed on Mar. 14, 2013.

(51) Int. Cl.

| | |
|---|---|
| ***E04C 5/16*** | (2006.01) |
| ***E04G 21/14*** | (2006.01) |
| ***E04B 1/35*** | (2006.01) |
| *E04B 1/26* | (2006.01) |

(52) U.S. Cl.

CPC ..... *E04G 21/14* (2013.01); *E04B 1/355* (2013.01); *E04B 1/26* (2013.01); *E04B 1/2608* (2013.01); *E04B 2001/2616* (2013.01); *E04B 2001/2684* (2013.01); *Y10T 16/554* (2015.01)

(58) Field of Classification Search

CPC ..... E04B 2/56; E05D 11/00; E04G 21/14; Y10T 16/554

USPC ..... 52/688, 745.11, 745.14, 745.15, 633

See application file for complete search history.

(56) References Cited

U.S. PATENT DOCUMENTS

| | | | | | |
|---|---|---|---|---|---|
| 2,812,077 | A | * | 11/1957 | Proctor | 414/11 |
| 3,485,386 | A | | 12/1969 | Miller | |
| 3,662,502 | A | * | 5/1972 | Wright | 52/93.2 |
| 3,785,108 | A | | 1/1974 | Satchell | |
| 4,005,556 | A | * | 2/1977 | Tuomi | 52/93.2 |
| 4,170,852 | A | | 10/1979 | Danis, Jr. | |
| 4,294,050 | A | * | 10/1981 | Kandel | 52/93.2 |
| 4,662,146 | A | | 5/1987 | Parry | |
| 4,718,564 | A | * | 1/1988 | Bailey | 212/179 |
| 4,831,807 | A | * | 5/1989 | Bolt | 52/641 |
| 5,833,430 | A | | 11/1998 | Reynolds et al. | |
| 5,943,830 | A | * | 8/1999 | Truitt | 52/127.2 |
| 5,983,577 | A | | 11/1999 | Hays | |
| 6,000,898 | A | | 12/1999 | Sharp | |
| 6,334,287 | B1 | | 1/2002 | Fick | |
| 7,765,755 | B2 | | 8/2010 | Williams | |
| 8,317,454 | B1 | * | 11/2012 | Parker | 414/770 |
| 2011/0154768 | A1 | * | 6/2011 | Kralic et al. | 52/578 |
| 2011/0308184 | A1 | * | 12/2011 | Ryan | 52/426 |

* cited by examiner

*Primary Examiner* — Mark Wendell
*Assistant Examiner* — Keith Minter
(74) *Attorney, Agent, or Firm* — Husch Blackwell LLP

(57) ABSTRACT

A method for installing a truss-wall stud unit includes coupling a set of bottom plates with a foundation, coupling a set of hinge brackets with the set of bottom plates, coupling a first partial truss with a second partial truss to form a truss-wall stud unit, coupling the truss-wall stud unit with the bottom plates and hinge brackets, and hoisting the truss-wall stud unit into a substantially vertical position. A system includes truss-wall stud units which are connected to bottom plates using hinge brackets. Once connected to the hinge brackets and bottom plates, the truss-wall stud units are hoisted upright into a substantially vertical position using a cable system with a cable support system. Temporary interlocking spacer bars are used to brace the truss-wall stud units at predetermined intervals.

5 Claims, 18 Drawing Sheets

TRUSS-WALL INSTALLATION SYSTEM AND RELATED METHODS

CROSS-REFERENCE TO RELATED APPLICATIONS

This application claims priority to U.S. Provisional Patent Application Ser. No. 61/781,765, filed Mar. 14, 2013, to Steve Ventling entitled 'Truss-Wall Installation System and Related Methods", the entire disclosure of which is incorporated herein by reference.

TECHNICAL BACKGROUND

Conventional wood framing typically involves pre-building walls on a cement or wood subfloor and then manually lifting the walls up and securing with bracing, nails, and/or anchor bolts attached to a concrete slab. Depending on the size of the building, the pre-built walls may need to be lifted and set into place in sections. Once the walls are lifted and set into place on the bottom plate, it is securely braced from numerous angles to ensure it does not collapse or fall due to winds. Without the assistance of heavy equipment, such as a forklift or a crane, the process of lifting and setting pre-built walls is dangerous due to the weight and instability of the walls.

Once the walls are set and braced, heavy equipment, such as a crane, is used to set trusses on top of the walls. The truss is lifted over the walls and maneuvered into place, requiring many workers. The process can be a dangerous, time consuming, and expensive process.

SUMMARY

The system includes truss-wall stud units, which are connected to bottom plates on a foundation using hinge brackets. Once connected to the hinge brackets and bottom plates, the truss-wall stud units are hoisted upright into a substantially vertical position using a cable hoisting system with a cable support system. An end wall unit is braced, for example, with a telescoping bracing bar attached to a stationary object, for example, a pickup truck. Temporary interlocking spacer bars are optionally used to separate and brace the upper truss members of the truss-wall stud unit at predetermined intervals, for example 24" intervals.

In one or more embodiments, a method for installing a truss-wall stud includes coupling a set of bottom plates with a foundation, coupling a set of hinge brackets with the set of bottom plates, coupling a first partial truss-wall stud with a second partial truss-wall stud to form a truss-wall stud unit, coupling the truss-wall stud unit with the bottom plates and hinge brackets, and hoisting the truss-wall stud unit into a substantially vertical position with use of a cable hoisting system, cable support system, and temporary interlocking spacer bar.

BRIEF DESCRIPTION OF THE FIGURES

Embodiments of the invention are disclosed with reference to the accompanying drawings and are for illustrative purposes only. The invention is not limited in its application to the details of construction or the arrangements of components illustrated in the drawings. The invention is capable of other embodiments or of being practiced or carried out in various other ways. Like reference numerals are used to indicate like components. In the drawings.

DETAILED DESCRIPTION OF THE EMBODIMENTS

The following detailed description includes references to the accompanying drawings, which form a part of the detailed description. The drawings show, by way of illustration, specific embodiments in which the invention may be practiced. These embodiments are also referred to herein as "examples." The drawings and following detailed description is not to be taken in a limiting sense, and the scope of the present invention is defined by the appended claims and their equivalents.

A truss installation system and related components and methods are described herein. The truss installation system includes truss-wall stud units that are connected to a bottom plate using novel hinge brackets that are affixed to the bottom plate. Once connected to the hinge brackets and bottom plate, the truss-wall stud units are hoisted upright into place using unique cable hoisting and support systems designed to pull a cable through part of the truss-wall stud unit, where the cable hoisting system hoists the truss-wall stud unit, and the cable support system supports the unit as it is being hoisted. The system further includes a temporary interlocking spacer bar which is affixed to a top of the unit prior to hoisting of the unit, and assists in bracing the unit at predetermined positions.

Figure 6:
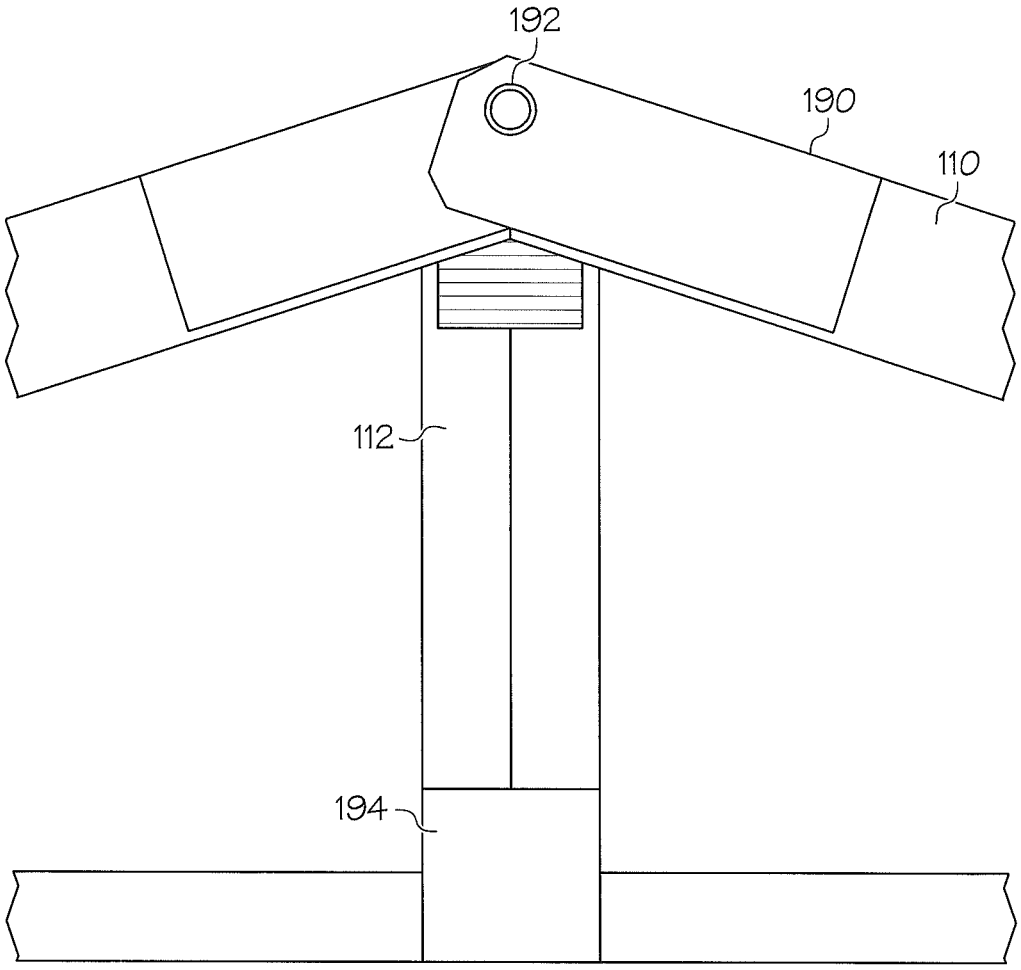
FIG. 6 illustrates a side elevation view of a portion of a truss-wall stud unit and folding beak peak bracket of a truss-wall stud installation system in accordance with one or more embodiments.
Figure 6A:
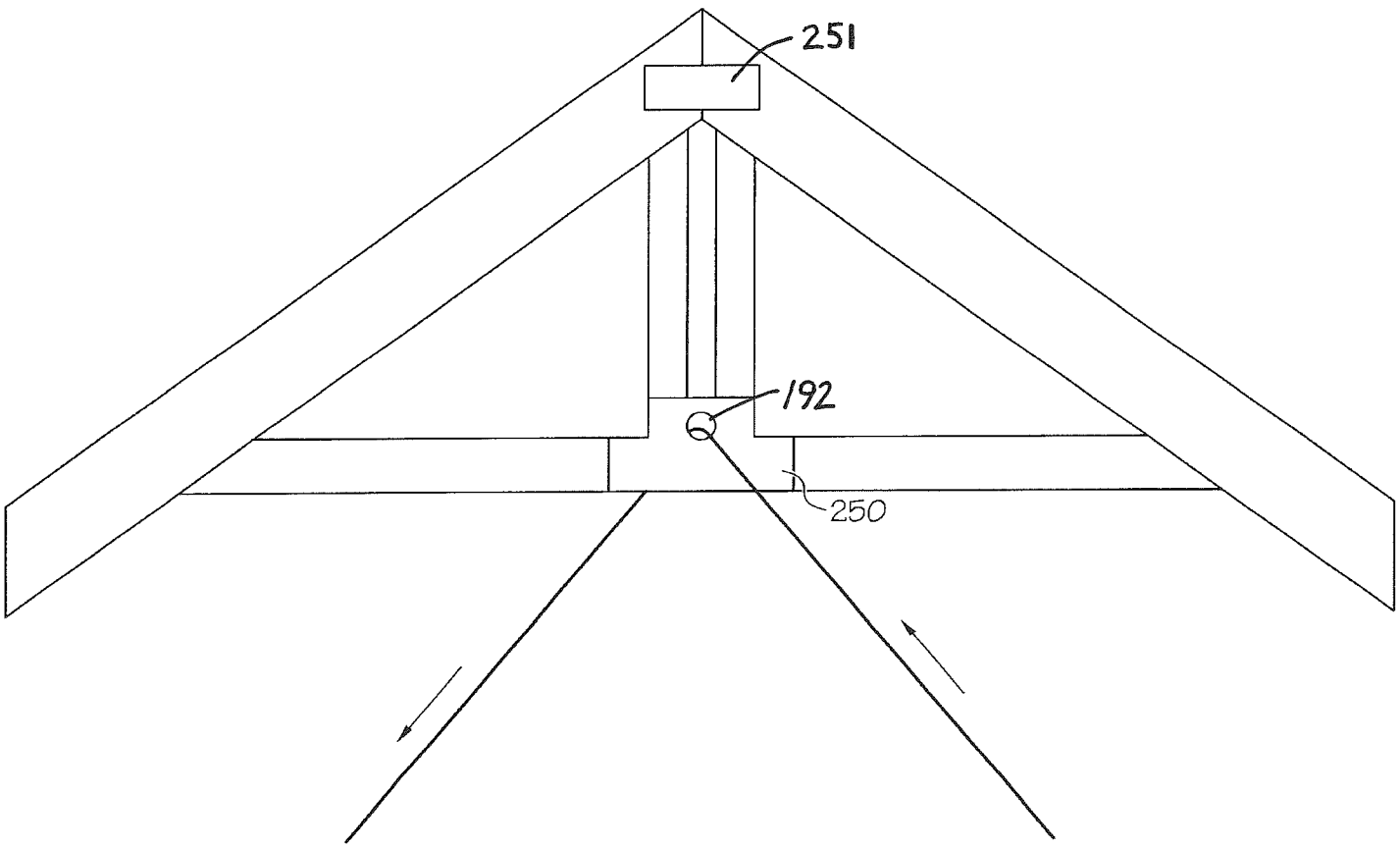
FIG. 6A illustrates a front view of a portion of a truss-wall stud unit, standard gusset plate, and bottom-chord splice bracket of a truss-wall stud installation system in accordance with one or more embodiments.
Figure 7:
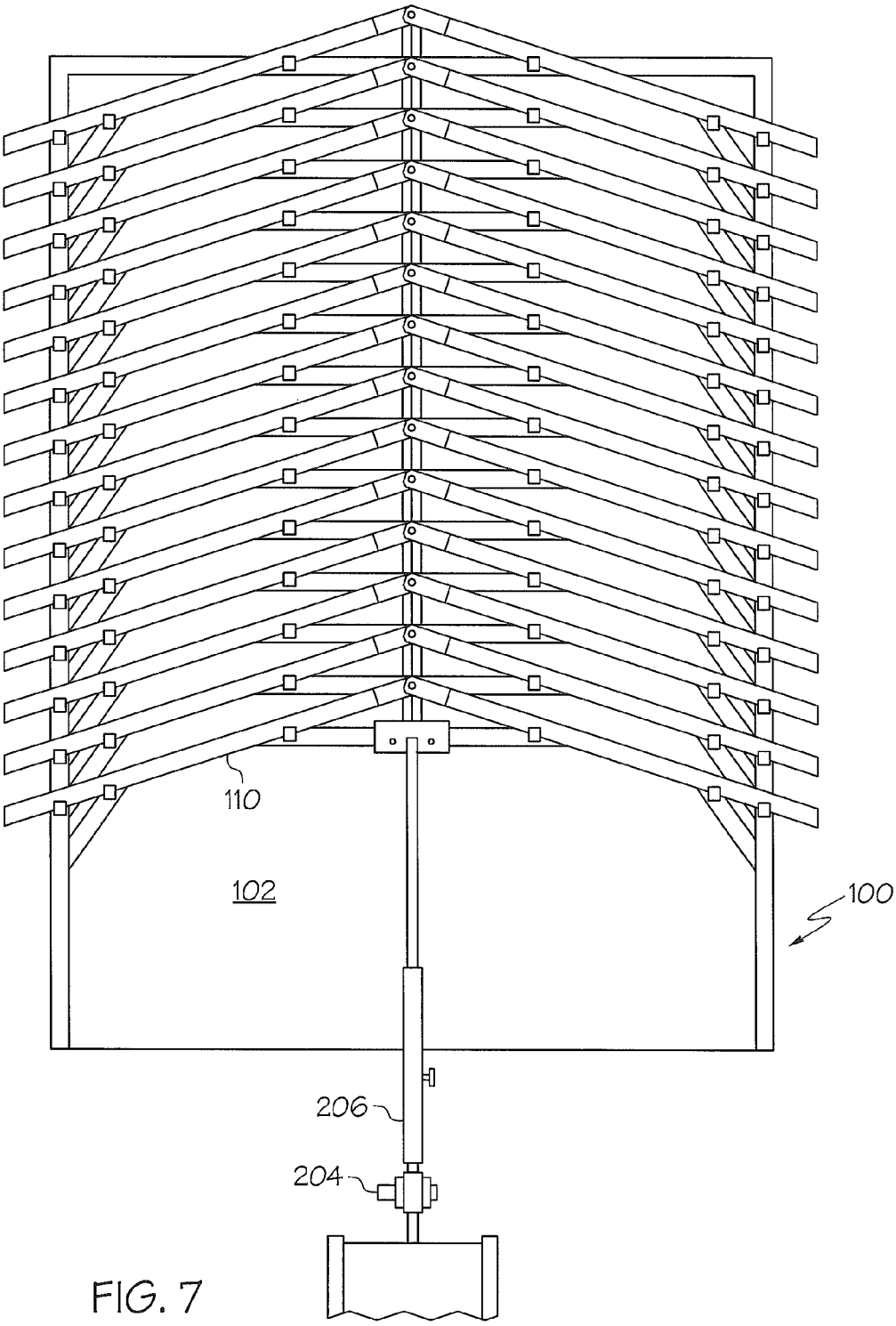
FIG. 7 illustrates a top plan view of a portion of a truss-wall stud installation system in accordance with one or more embodiments.
Figure 8:
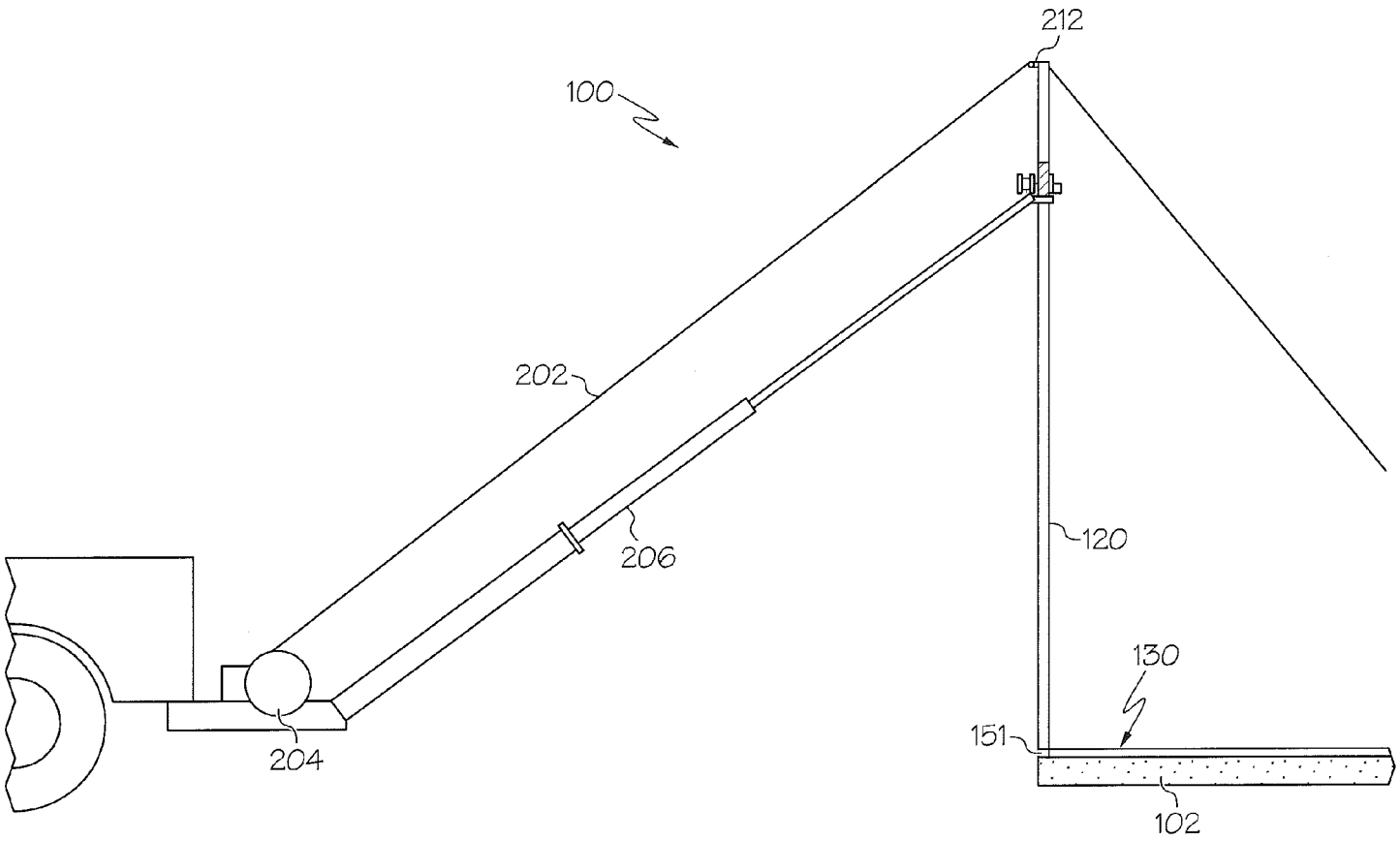
FIG. 8 illustrates a side view of the cable system, the telescoping bracing bar, and the end truss-wall stud unit of the truss-wall stud installation system in accordance with one or more embodiments.
Figure 9:
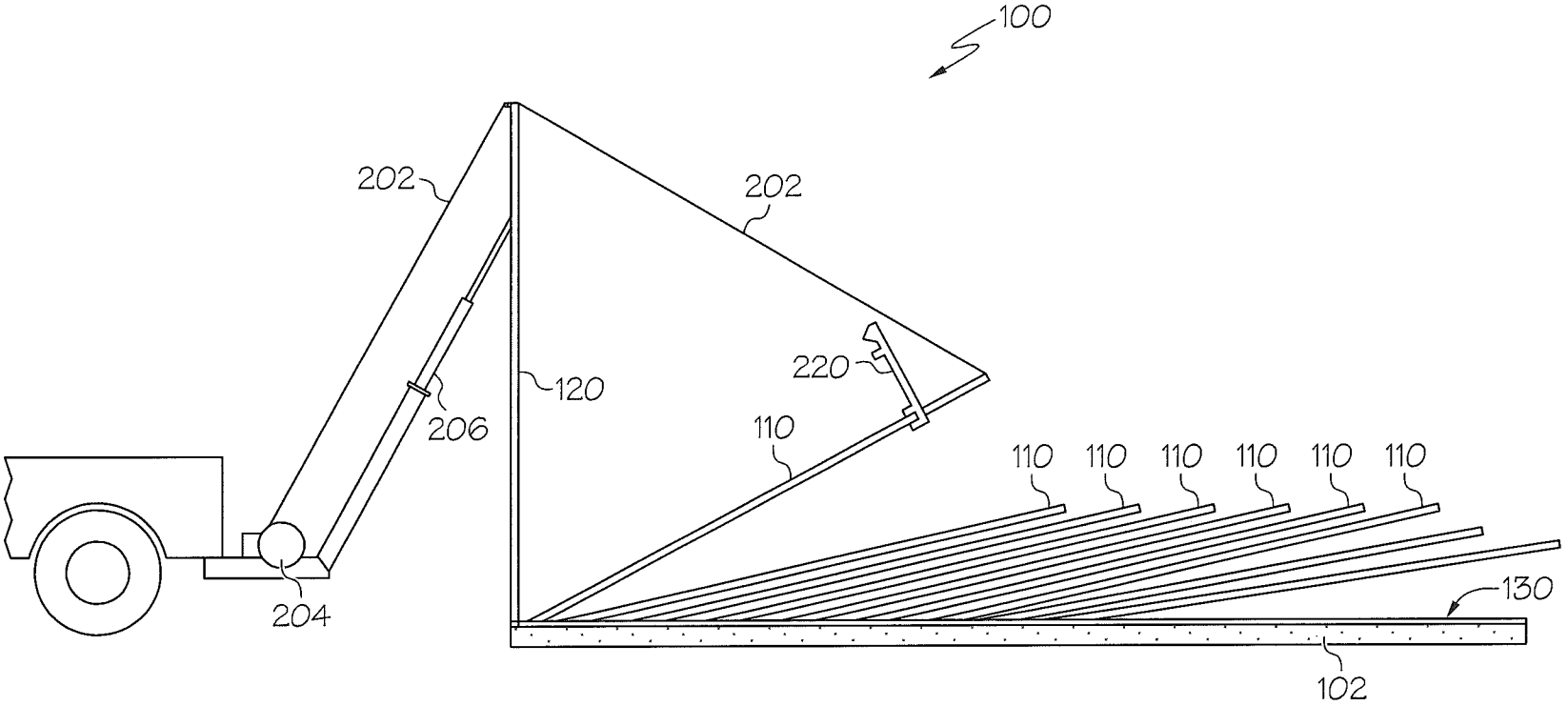
FIG. 9 illustrates a side view of the cable system, the telescoping bracing bar, and the truss-wall stud unit(s) of the truss-wall stud installation system in accordance with one or more embodiments.

Referring to FIGS. 1-16, the system 100 is used with a foundation 102, and includes a truss-wall stud unit 110. The truss-wall stud unit 110 is formed of two or more partial truss-wall stud units 118, and can further include an end truss-wall stud unit 120. The truss-wall stud units are formed of a series of web units 112 that are coupled together to form the truss-wall stud unit. The truss-wall stud units 110 can have a variety of shapes. For example, the truss-wall stud units can have an outer wall, central support, truss support, or a roof line. The truss-wall stud units can be pre-assembled at a factory, for example, prior to delivery at a construction site. The partial truss-wall stud units 118 can be fastened together at the job site, for example, using a folding peak bracket 190 as shown in FIG. 6 along the top portion of the truss-wall stud unit, and a lower connection plate 194 along the lower portion of the truss-wall stud unit 118. The folding peak bracket 190 includes a passage 192 therethrough for the cable system. In one or more embodiments, the passage 192 may be located in another location other than in the folding peak bracket 190. For example, the cable may be routed through another location or another part; such as, but not limited to, a location lower on the truss. Alternatively, the partial truss-wall stud units 118, can be fastened together at the job site, for example, using a standard gusset plate 251 and a bottom chord splice plate 250 as shown in FIG. 6A.

The foundation 102 can include a cement slab, cement footings, or traditionally used building foundations with treated timber bottom plates affixed therein with anchor bolts. The bottom plates 130 are used in conjunction with bottom hinge brackets 150, 151 (FIGS. 2-4, 8) to support the truss-wall stud units 110. The bottom plates 130 are assembled to the foundation 102 with anchor bolts.

The hinge brackets 150 are installed on the foundation offset from the anchor bolts. For example, the anchor bolts can be installed at odd intervals, and the hinge brackets 150 at even intervals and the end hinge brackets 151 are installed at the outer portions of the foundation 102.

Figure 1:
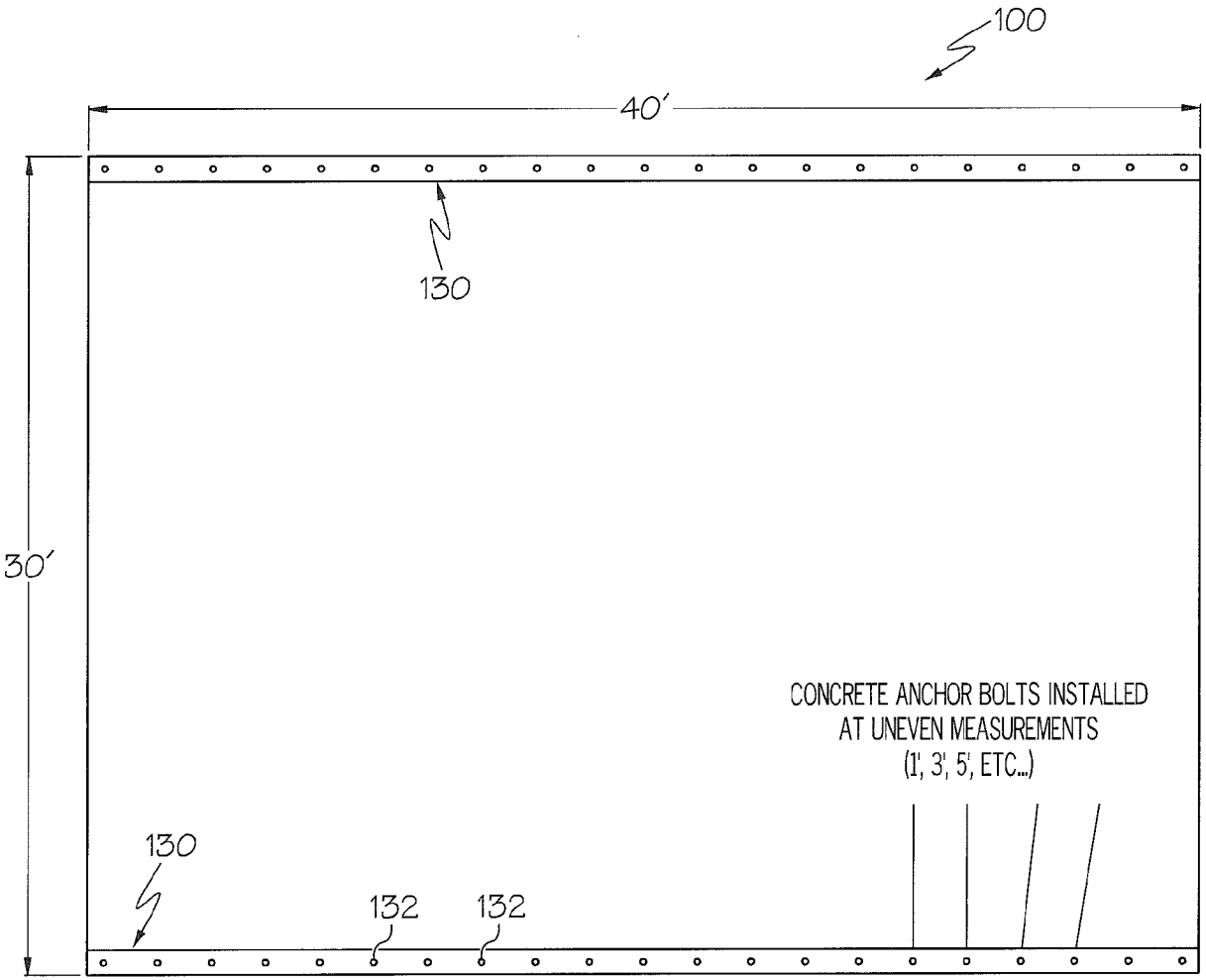
FIG. 1 illustrates a top plan view of a portion of a truss-wall stud installation system at a job site in accordance with one or more embodiments.
Figure 2:
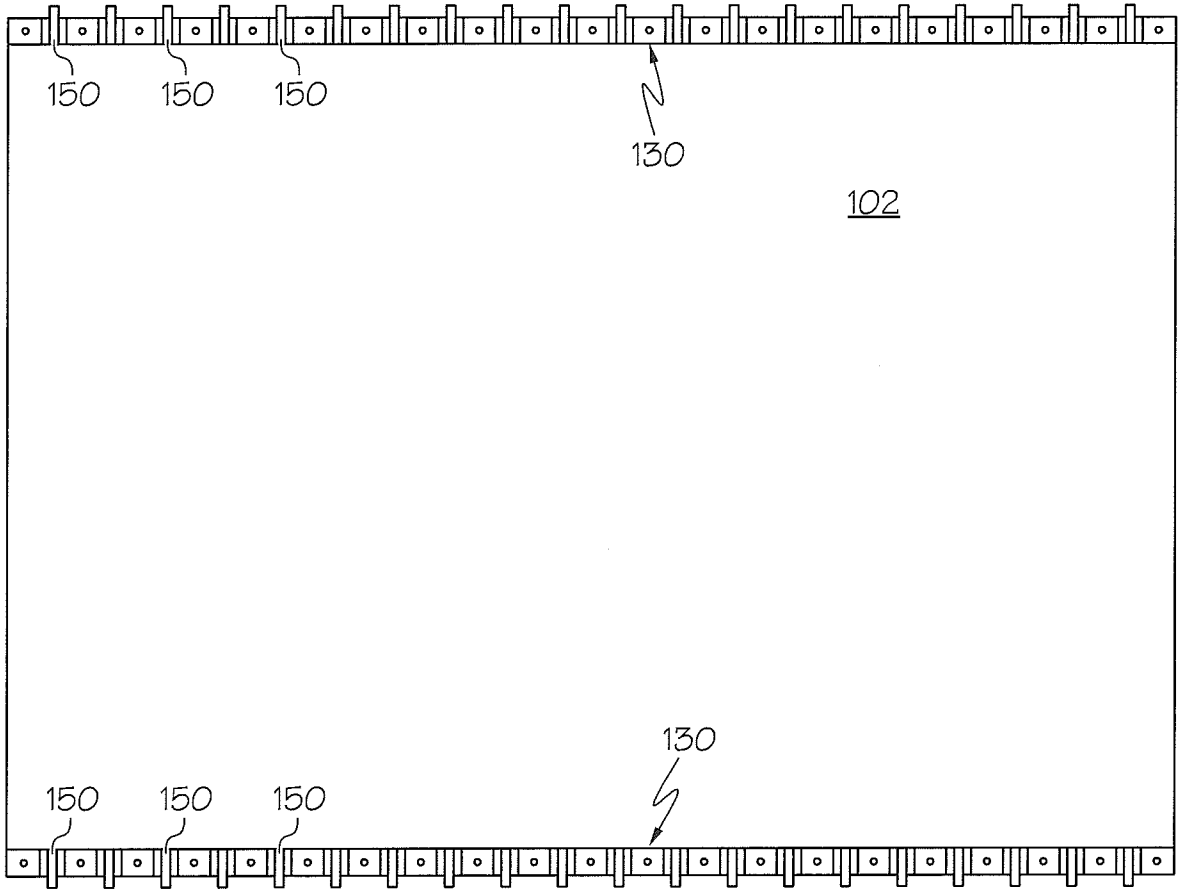
FIG. 2 illustrates a top plan view perspective view of a portion of a truss-wall stud installation system in accordance with one or more embodiments.
Figure 3:
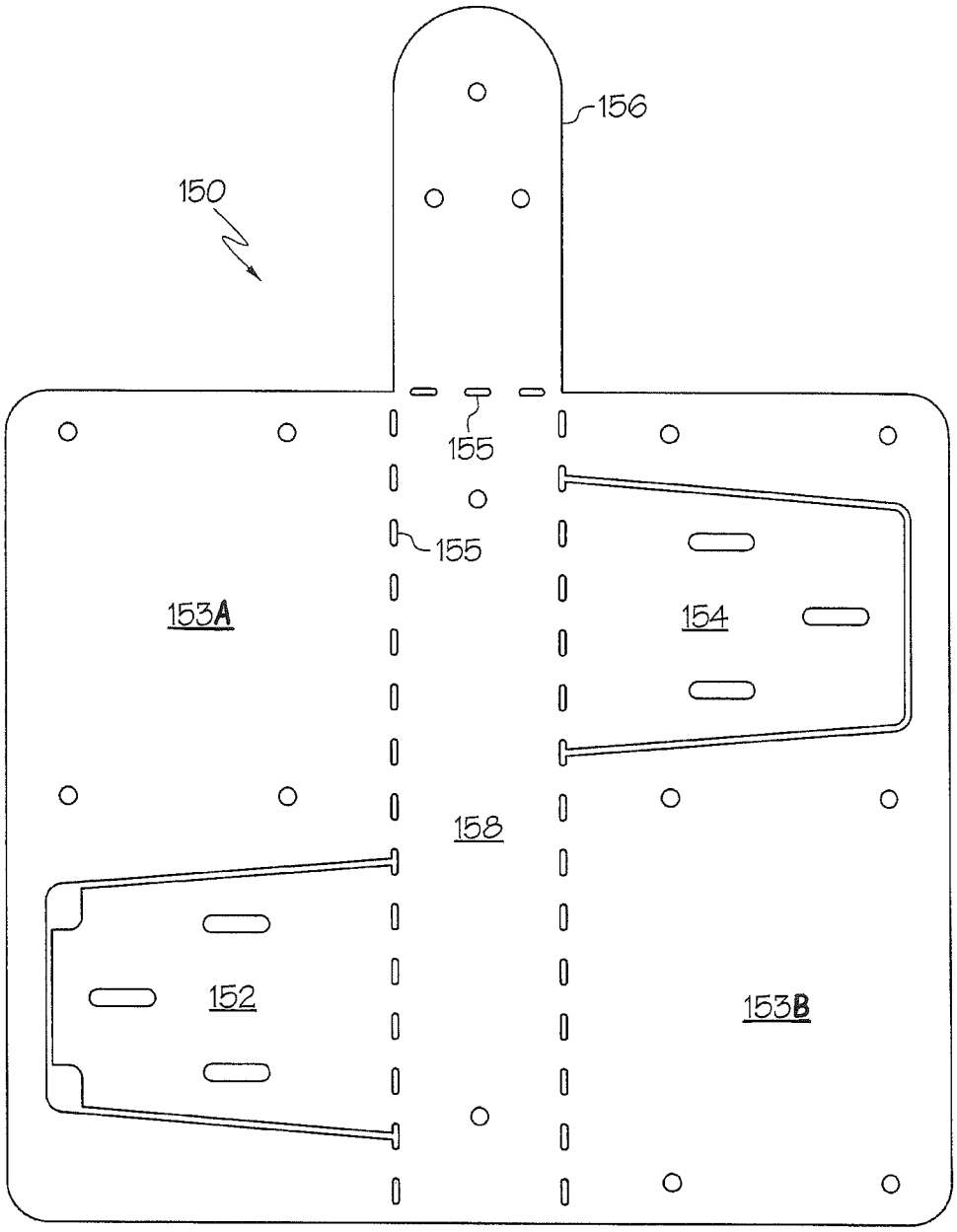
FIG. 3 illustrates a top plan view of a hinge bracket of a truss-wall stud installation system in accordance with one or more embodiments.

The hinge bracket 150, as shown in FIG. 3, includes two main portions 153A and 153B, a first inner portion 152, a second inner portion 154, within the main portions 153A and 153B, and an outside tab 156. The first inner portion 152 and the second inner portion 154 are disposed at least partially within the main portions 153A and 153B and are foldable relative to the main portions 153A and 153B. The hinge bracket 150 further includes an intermediate portion 158 disposed between the first inner portion 152 and the second inner portion 154, and the first and second inner portions 152, 154 are hingedly coupled relative to the intermediate portion 158 along a fold line 155. The hinge bracket 150 includes a number of nailing holes allowing for the hinge bracket 150 to be secured to the bottom plate. The fastener holes on the brackets, in one or more embodiments, are elongate in order to position and center the bracket for installation, and to account for inconsistencies in the concrete slab or foundation.

The first inner portion 152 and the second inner portion 154 are adapted to be folded up along fold lines 155 (i.e. slotted holes) and attached to a truss-wall stud unit leg. The outside tab 156 is further configured to be folded up along a fold line 155 (i.e. slotted holes) and attached to the truss-wall stud unit leg. The first inner portion 152 is opposite the second inner portion 154 with the intermediate portion 158 therebetween. After the first main portion 153A is affixed to the bottom plate, the first inner portion 152 and the intermediate portion 158 are assembled to the truss-wall stud unit leg prior to lifting into vertical position, and the second inner portion 154 is assembled to the truss-wall stud unit leg after the truss-wall stud unit is lifted toward the vertical position.

Figure 4:
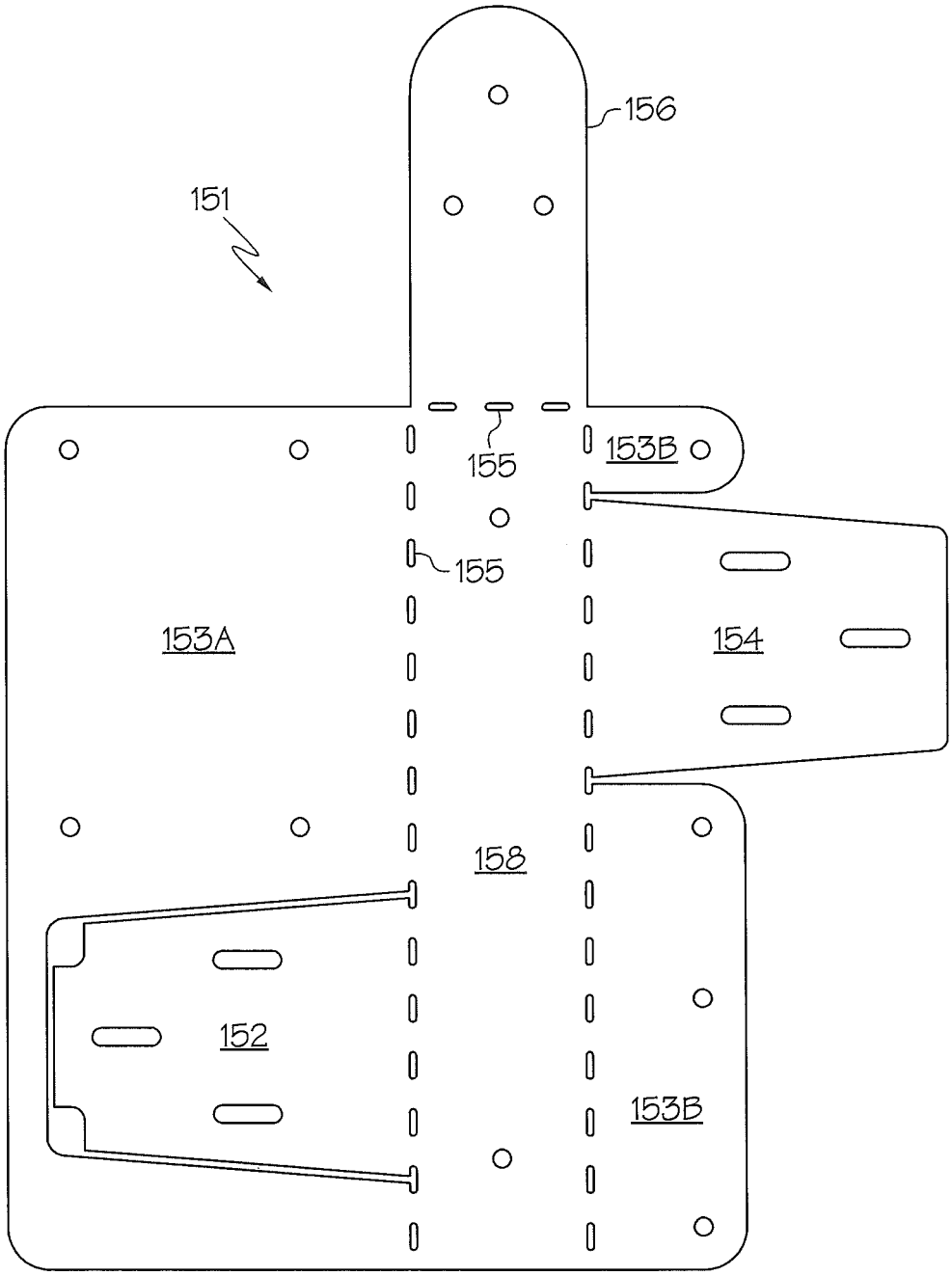
FIG. 4 illustrates a top plan view of an end hinge bracket of a truss-wall stud installation system in accordance with one or more embodiments.
Figure 5:
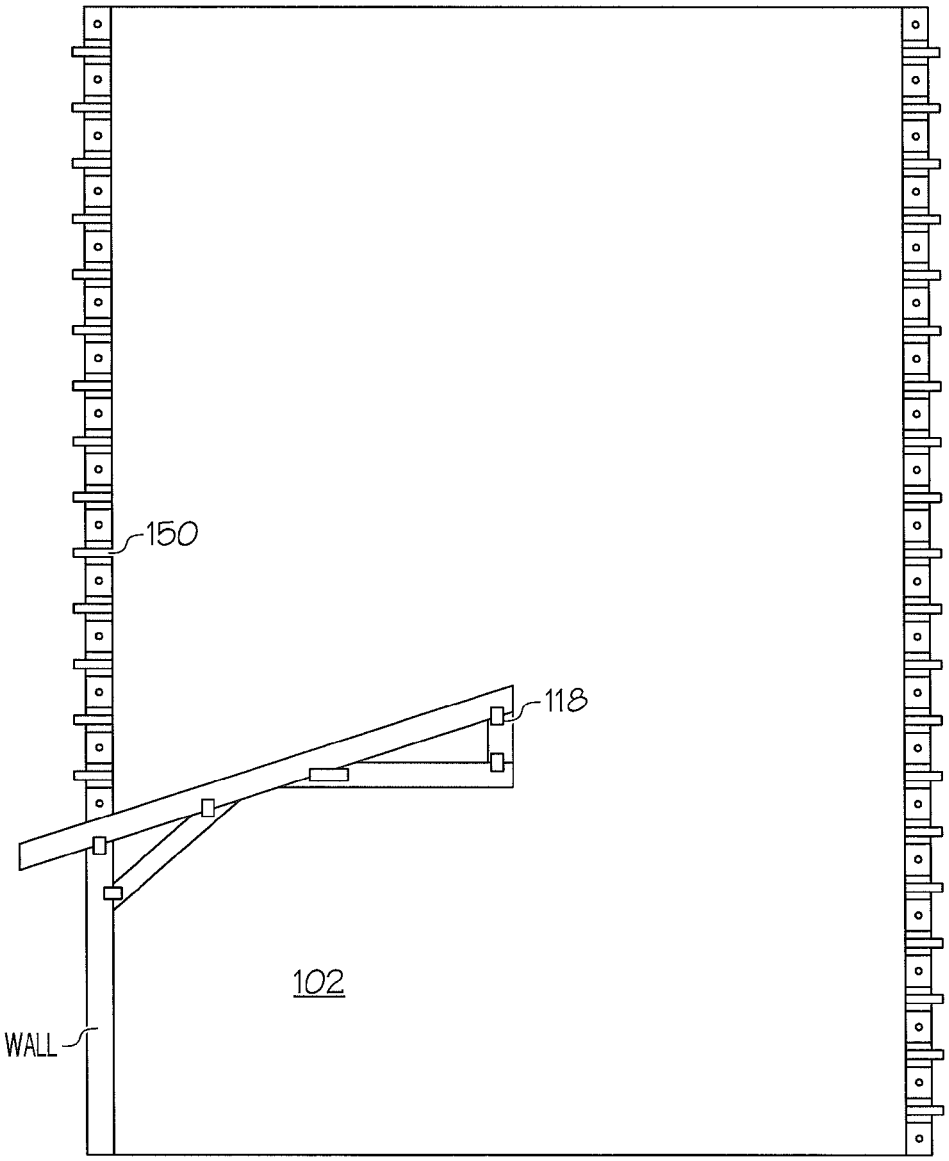
FIG. 5 illustrates a top plan view of a portion of a truss-wall stud installation system in accordance with one or more embodiments.

FIG. 4 illustrates an end hinge bracket 151 which differs from the hinge bracket 150 in that the second main portion 153B attaches to the bottom plate by folding down vertically along the end of the bottom plate. The first inner portion 152, second inner portion 154, and outside tab 156 are foldable like a hinge relative to the main portions 153A and 153B.

Referring to FIGS. 11A and 11B, 11C and 11D, the system 100 includes temporary interlocking spacer bar 220, where the figures illustrate variations for the spacer bar 220. The temporary interlocking spacer bar 220 includes an elongate member extending from a first end portion to a second end portion and having an intermediate portion therebetween. The first end portion and the second end portion of the temporary interlocking spacer bar 220 have a retention member, where the retention member is sized to receive and retain a truss member therein. In an example, the retention member includes a U-shaped member. The first and second end portions are sized to space two or more truss member studs. In an embodiment, the temporary interlocking spacer bar 220 includes an outer curved portion opposite the retention member, allowing for the temporary interlocking spacer bar 220 to ride over a portion of an adjacent truss-wall stud unit before it slips securely into place during the hoisting of the truss-wall stud unit.

In one or more embodiments, the temporary interlocking spacer bar is plastic, metal, or similar material. In another embodiment, the temporary interlocking spacer bar further includes rib supports disposed near one or more end portions.

Referring to FIGS. 7-10, 12, 12A, 12B, 14, and 16, the system 100 further includes a cable system including a cable 202, a winch 204, a telescoping bracing bar 206, a pulley 212, and weights. The cable system is used to hoist, stabilize, and support the truss-wall stud unit 110 into the vertical position as further described below.

Figure 12:
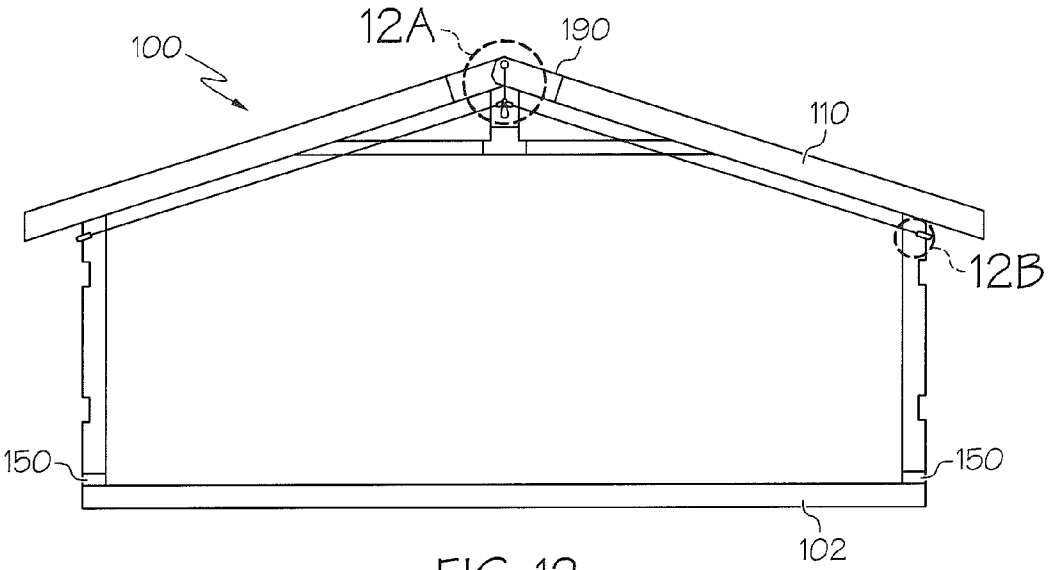
FIG. 12 illustrates an end view of a portion of a truss-wall stud installation system in accordance with one or more embodiments.

Referring generally to FIGS. 1-16, a method of use of the system 100 is as follows. For ease of shipping and handling, in an option, truss-wall stud units 110 are shipped to a job site, for example in halves. Each half includes a stud leg, which is affixed to half of a roof truss with truss fasteners, such as gang nails. In one or more embodiments, engineered webbing under a peak of the truss is split in half at the bottom chord for shipping. Optional notches are cut into each stud leg at intervals for placement of the lateral bracing, as shown in FIG. 12. A top notch is cut into the peak of each partial truss-wall stud 118 for placement of the folding peak bracket, including a passage, such as a grommet, for a lifting cable to pass therethrough. Alternatively, adjoining portions such as halves have a small gap when joined, allowing the cable grommet to be attached to brackets or plates that allow the lifting cable to pass therethrough.

Anchor bolts are used to set bottom plates at a foundation, such as, but not limited to, a cement slab. The anchor bolts are set at intervals, for example, at odd measured intervals. Hinge brackets are affixed to the bottom plates, for example, by fastening to a portion of the bottom bracket. The hinge brackets are set offset from the anchor bolts, for example, at even measured intervals, preventing interference between the anchor bolts and the hinge brackets.

To set the first end wall 120, partial truss-wall stud units, such as two halves are placed on the foundation with the peak tips together and the ends of each stud resting on top of the end wall bottom brackets. The folding peak brackets 190 are then positioned on the peak halves and fastened from the top side. Alternatively, a bottom-chord splice bracket 250 may be used. The bottom side is fastened during the hoisting process. The partial truss-wall stud units are connected together to form an end wall truss-wall stud unit.

After affixing the first main portion 153A of the end-wall hinge bracket to the bottom plate, the stud ends of the end wall truss-wall stud unit 120 are fastened to the end-wall hinge bracket 151 by bending the intermediate portion 158 and the second inner portion 154 of the end-wall hinge bracket 151 up over the stud of the truss-wall stud unit, and fastened thereto. The end wall is hoisted, and the second main portion 153B of the end-wall hinge bracket is affixed vertically to the bottom plate end. The truss-wall stud unit is set to plumb and securely braced so that the subsequent truss-wall stud units can be correctly set.

In order the hoist the end wall, the cable system, which includes a winch 204, is used. The winch 204, for example, mounted to a receiver hitch on a vehicle, is moved to a location near the end wall, for example approximately five to ten feet from the end wall. Cable 202 is released from the winch to pass the cable through the passage 192 in the peak of the truss-wall stud unit as it is lying on the ground, or alternatively through the passage 250 mounted on the bottom-chord of the truss-wall stud unit. Once the cable is passed through the passage 192 of the bracket 190, or alternatively 250, the pulley 212 is installed in the grommet of the passage under the cable in order to allow free movement of the cable as subsequent truss-wall stud units 110 are hoisted into place.

Figure 12B:
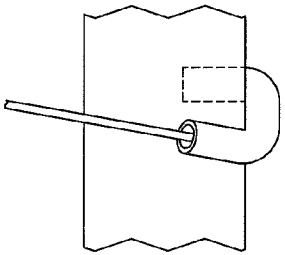
FIG. 12B is a partial view of the end view of a portion of a truss-wall stud installation system of FIG. 12.
Figure 12A:
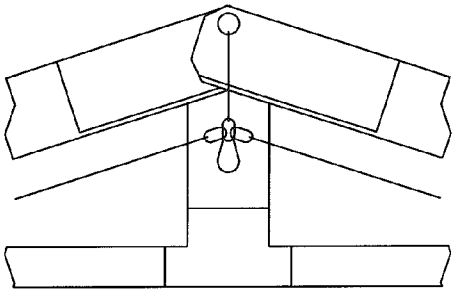
FIG. 12A is a partial view of the end view of a portion of a truss-wall stud installation system of FIG. 12.
Figure 13:
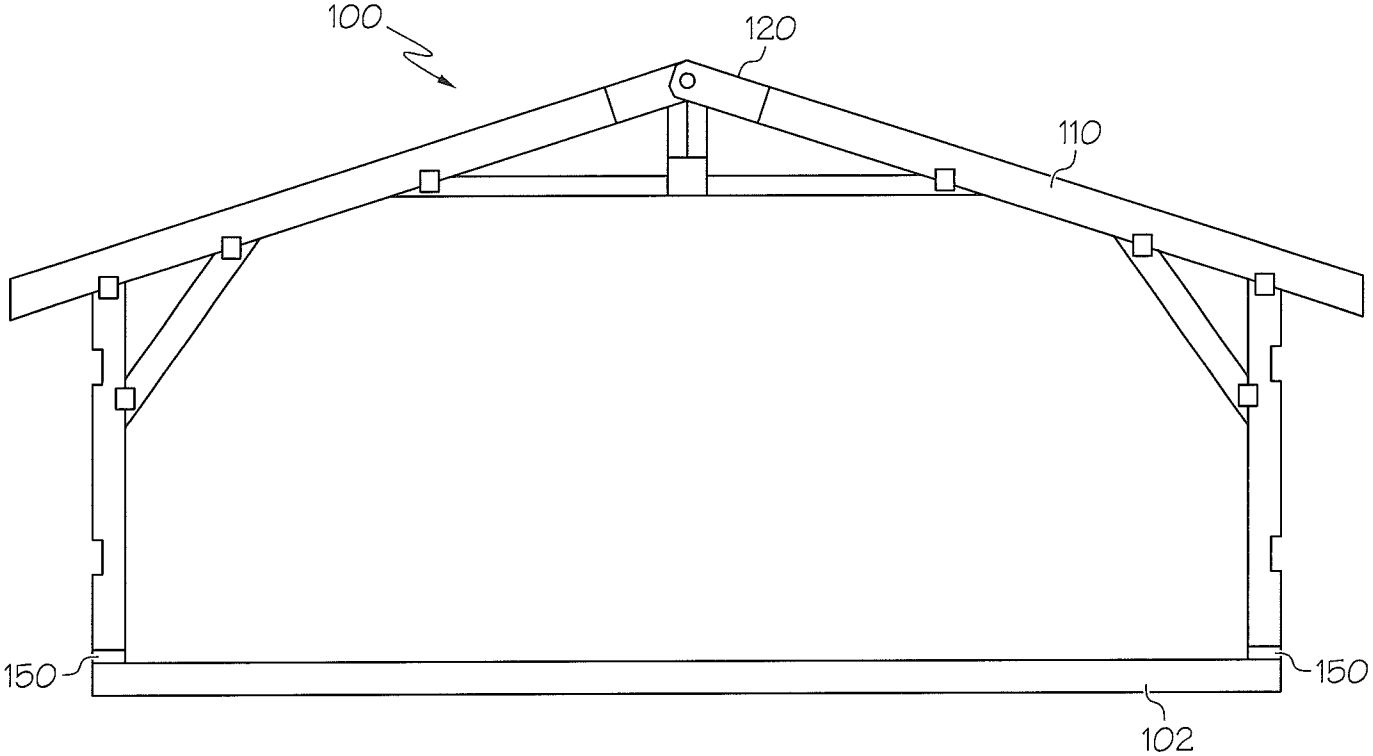
FIG. 13 illustrates an end view of a portion of a truss-wall stud installation system in accordance with one or more embodiments.
Figure 14:
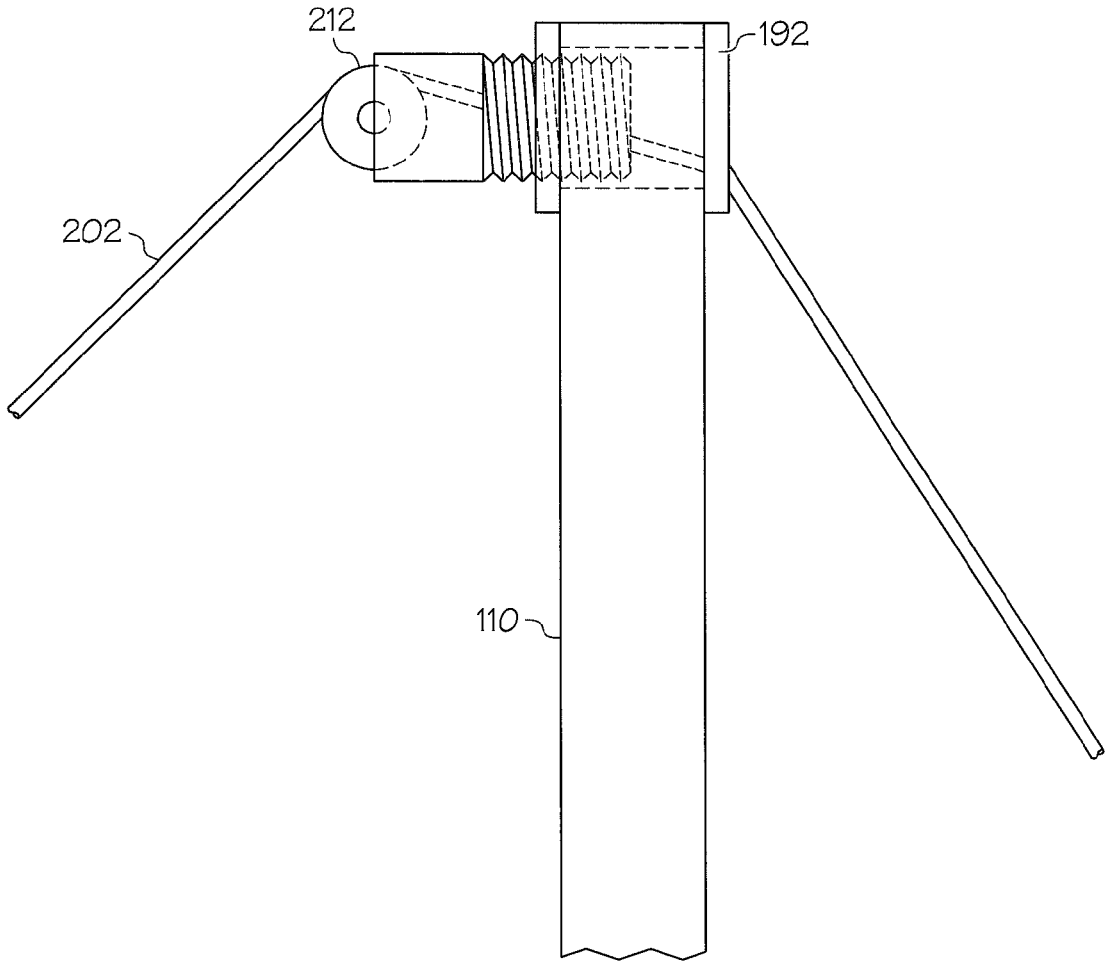
FIG. 14 illustrates a side view of a pulley of a truss-wall stud installation system in accordance with one or more embodiments.
Figure 15:
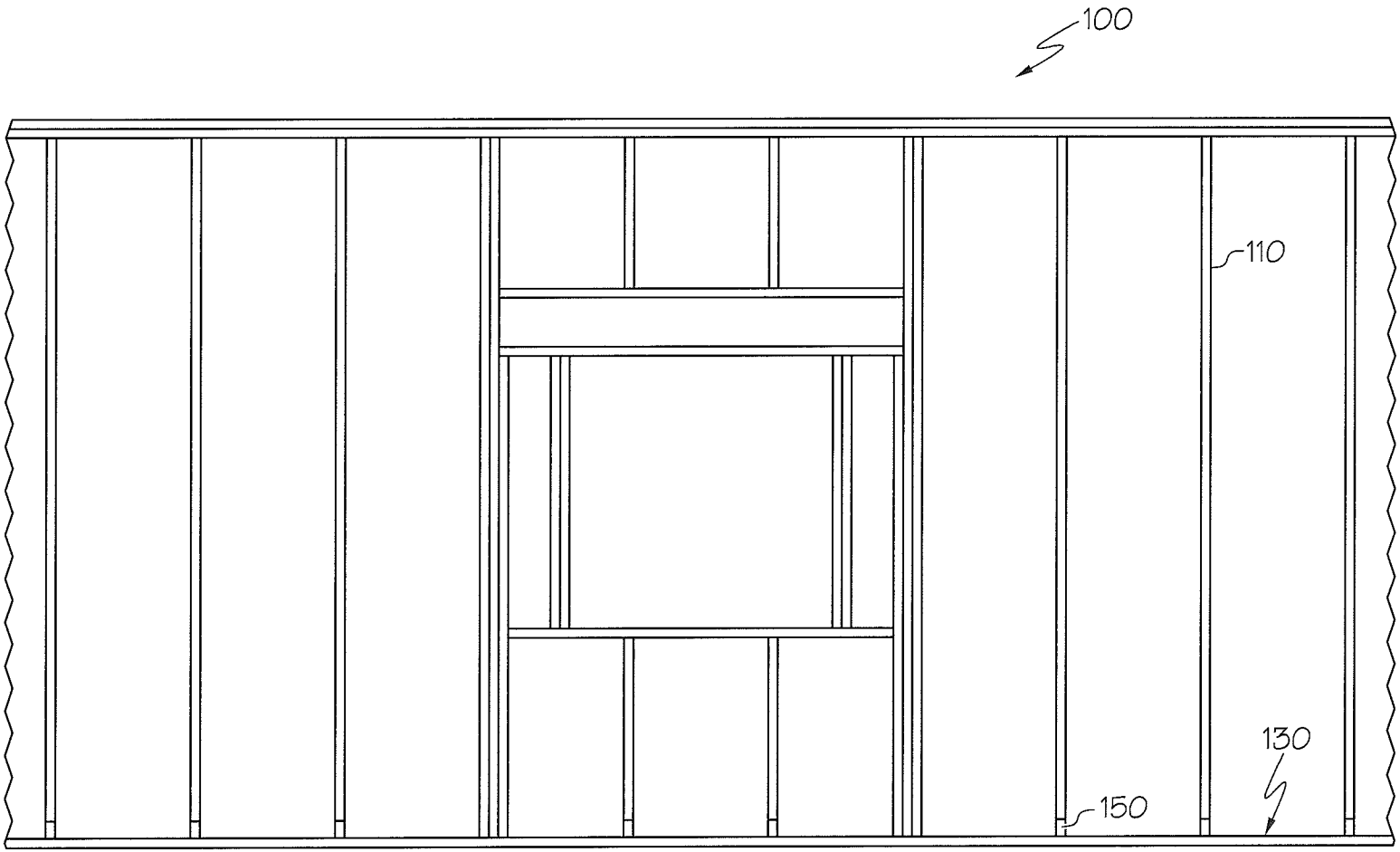
FIG. 15 illustrates a side view of a portion of a truss-wall stud installation system in accordance with one or more embodiments.
Figure 16:
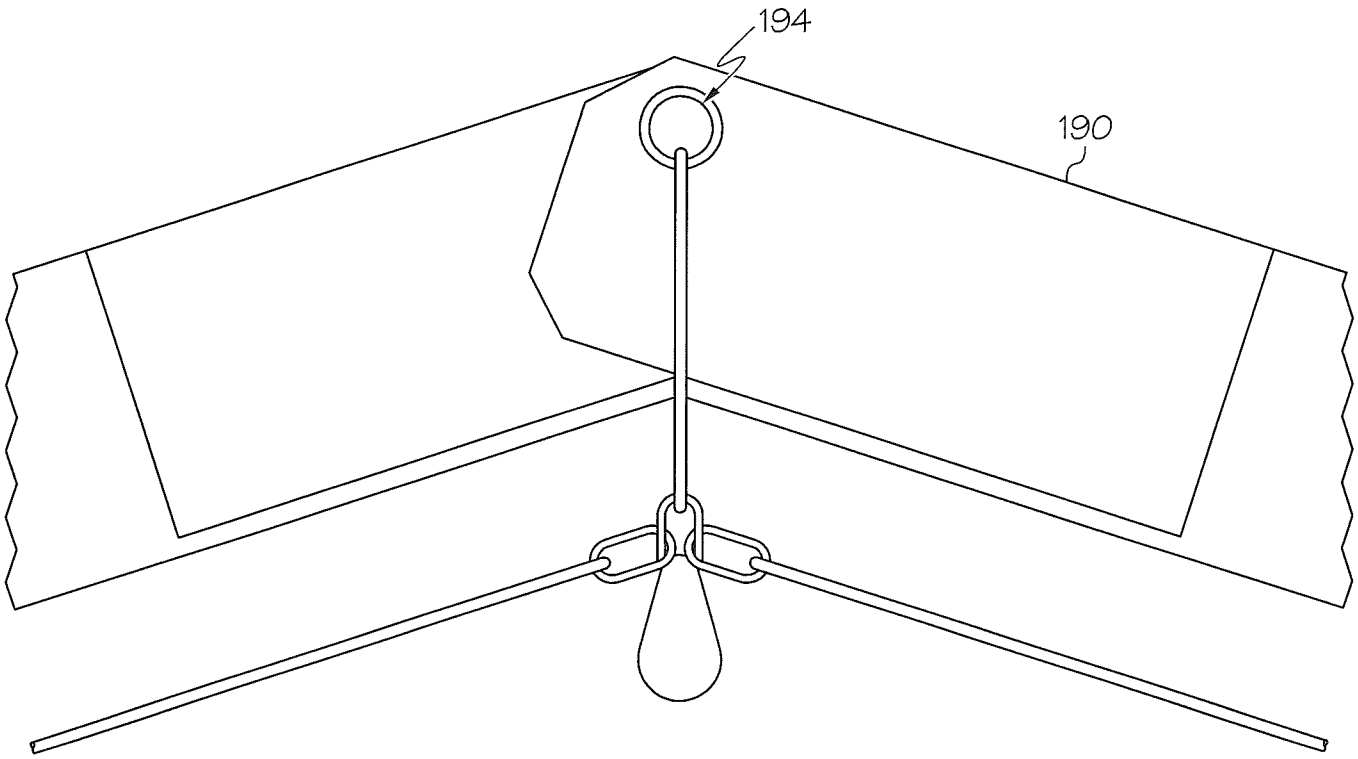
FIG. 16 illustrates a side view of a cable system of a truss-wall stud installation system in accordance with one or more embodiments.

After the pulley is installed in the end wall, the end of the cable (which is hanging underneath the grommet on the ground) is attached to the three point weighted cable lifting device (FIGS. 12, 12A, 12B, and 16). For instance, two hooks, for example J shaped hooks, on the ends of the three-point weighted cable lifting device are then hooked under each of the eaves of the truss-wall stud unit as it lies on the ground (FIGS. 12, 12A, and 12B). A telescoping bracing bracket is clamped to the bottom chord and attached to a pivoting receiver on a support, such as a vehicle hitch. The device will end and pivot up as the truss-wall stud unit is hoisted into a vertical orientation.

The winch is retracted, for example using a remote controlled device, and hoisting the entire truss-wall stud unit, which is lifted, and steadily supported by the cable system. The end truss-wall stud unit is lifted towards a vertical orientation such that the bottom of the folding peak bracket 190 and the flat bottom chord bracket 194 can be installed, or alternatively bottom-chord splice bracket 250 and standard gusset plate 251. The end truss-wall stud unit is further lifted until positioned in the vertical orientation. Once in the vertical position, the first inner portion 152 of the end hinge bracket 151 is bent up and fastened against the stud leg, and the outside tab 156 is bent up and fastened to the stud, for instance, to the outside edge of the stud.

After the end hinge brackets are completely fastened to the stud, the end truss-wall stud unit is measured for plumb, for example through use of a laser leveling device or plumb bob on the foundation slab under the peak of the truss-wall stud unit. Once the unit is plumb, a telescoping bracing bracket 206 is secured, and temporary bracing members are affixed diagonally from the outside stud legs of the bottom plate. The temporary braces and the telescoping bracing bracket remains in place and clamped to the end wall bottom chord and braced against the stationary vehicle. The winch 204 is reversed to release the cable lifting device from the eaves and center of the end truss-wall stud unit and lowered back to hoist the next truss-wall stud unit.

Two or more partial truss-wall stud units 118 are placed together, such as truss-wall stud unit halves, and secured near the peak for example on a top side of the peak with folding peak brackets and fastened along the top side of the bottom chord with the flat bottom chord bracket 194. Alternatively, two or more partial truss-wall stud units 118 may be secured at the peak for example on a top side of the peak with a standard gusset plate 251 and fastened along the bottom chord with the bottom chord splice bracket 250

Figure 10:
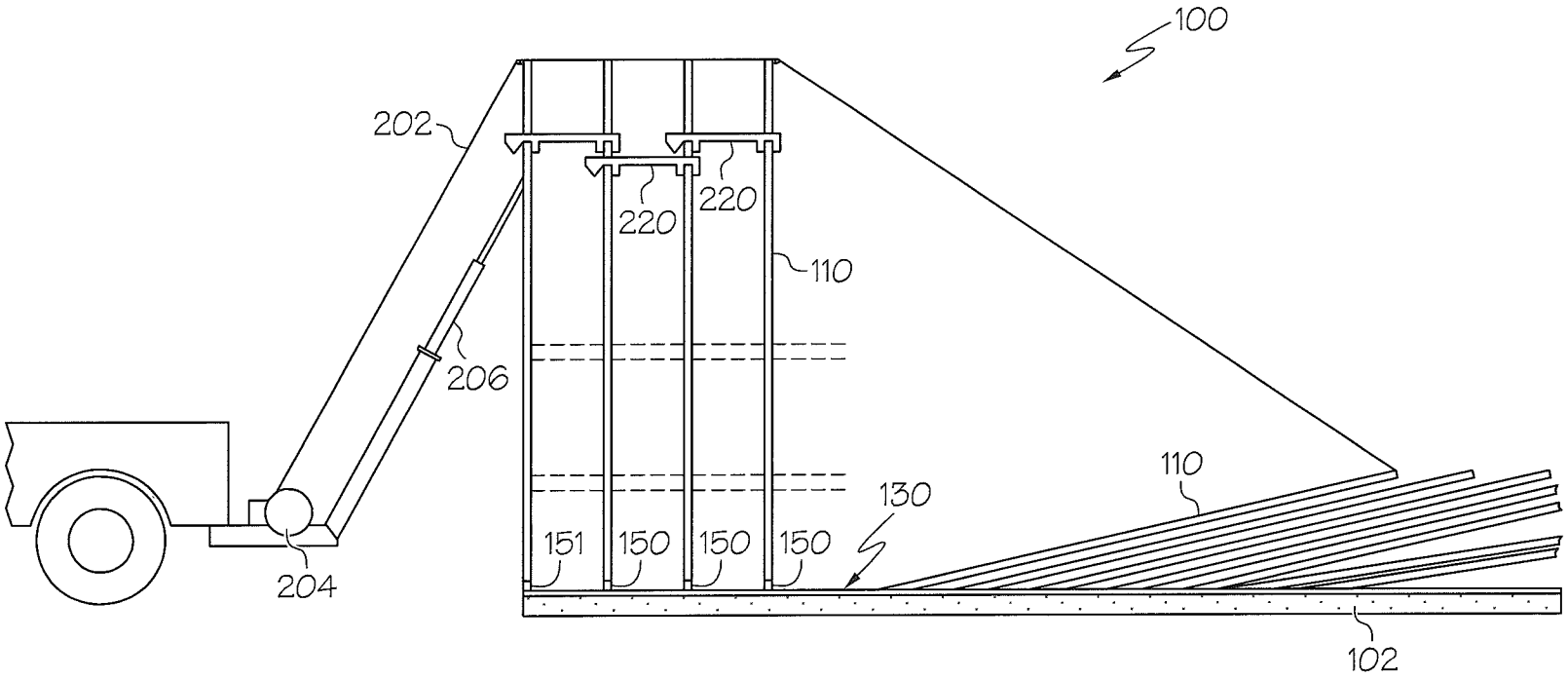
FIG. 10 illustrates a side view of the cable system, the telescoping bracing bar, and the truss-wall stud unit(s) of the truss-wall stud installation system in accordance with one or more embodiments.
Figure 11A:
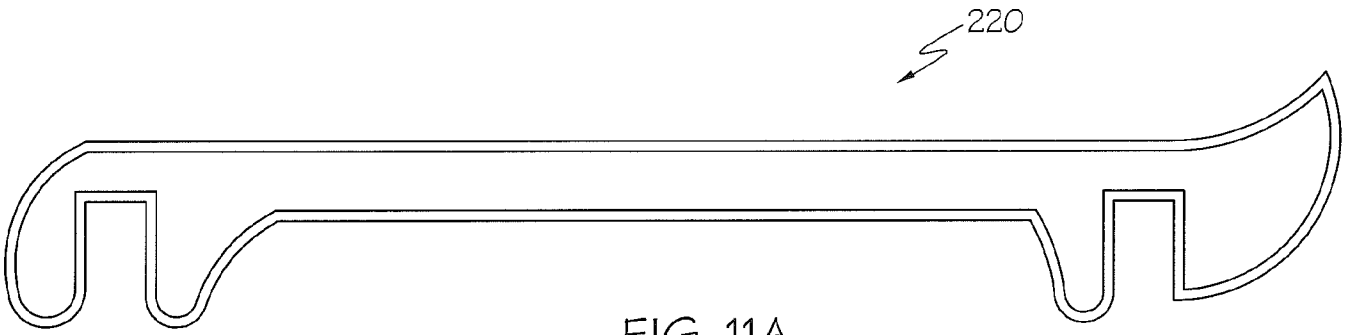
FIG. 11A illustrates a perspective view of a temporary interlocking spacer bar of a truss installation system in accordance with one or more embodiments.
Figure 11B:
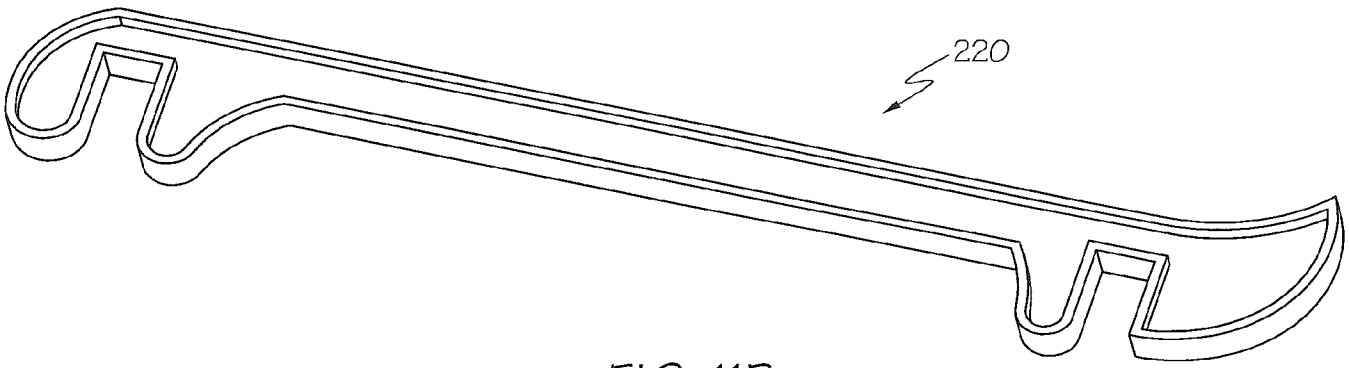
FIG. 11B illustrates a perspective view of a temporary interlocking spacer bar of a truss-wall stud installation system in accordance with one or more embodiments.
Figure 11C:
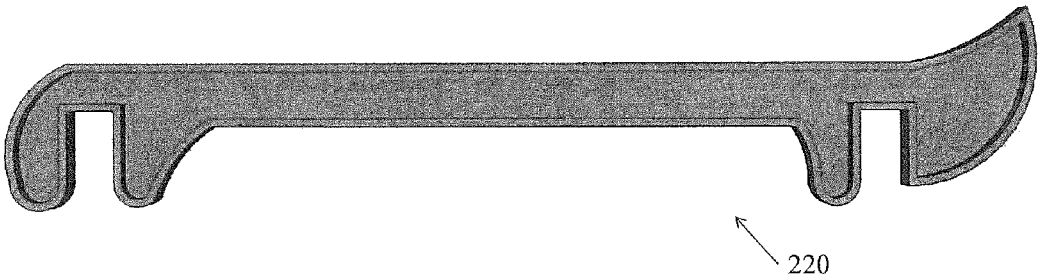
FIG. 11C illustrates a side view of a temporary interlocking spacer bar of a truss installation system in accordance with one or more embodiments.
Figure 11D:
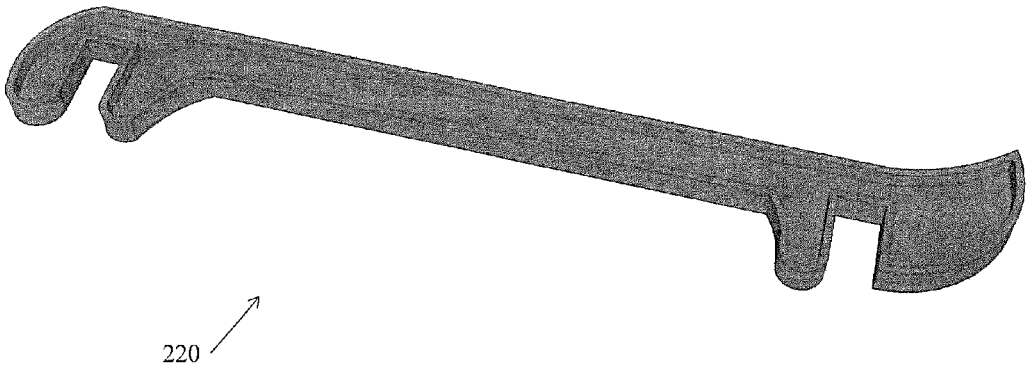
FIG. 11D illustrates a perspective view of a temporary interlocking spacer bar of a truss-wall stud installation system in accordance with one or more embodiments.

After affixing the first main portion 153A of the hinge bracket to the bottom plates, the bottom hinge bracket 150 are fastened to the truss-wall stud unit legs by bending the intermediate portion 158 and the first inner portion 152 of the hinge bracket up over the stud and fastening thereto. One or more temporary interlocking spacer bars 220 are fastened to a top member of the truss-wall stud unit, for example on each side of the peak of the truss-wall stud unit, approximately 3-5 feet from the peak, as shown in FIG. 10.

After the temporary interlocking spacer bars are fastened, the cable is passed through the passage 192 and attached to the three point weighted cable device of the cable system. The weighted cable device is coupled with the truss-wall stud unit, for example by coupling J shaped hooks on ends of the three point weighted cable device under each of the eaves of the truss-wall stud unit as it lies on or near the foundation or ground (see FIGS. 12, 12A, and 12B). The winch is retracted, for example, using a remote controlled device, and the truss-wall stud unit 110 is lifted toward the vertical orientation.

The truss-wall stud unit is hoisted about 5-6 feet and paused, enabling fasteners to be affixed to the bottom side of the folding peak bracket and flat bottom chord bracket. The truss-wall stud unit is then hoisted into vertical position. As it is hoisted, the temporary interlocking spacer bars 220 ride over the top of the previous truss-wall stud unit until they slip securely into place onto the previous truss-wall stud unit.

Once the truss-wall stud unit is in the vertical position, the second inner portion 154 of the hinge bracket 150 is bent up and fastened against the stud leg of the truss-wall stud unit, and the outer tab 156 is bent up and fastened to the outside edge of the stud. The winch is reversed, releasing the weighted cable lifting device from the peak and eaves of the truss-wall stud unit, and lowered back to the ground to hoist the next truss-wall stud unit 110. The process is repeated for subsequent truss-wall stud units until the final end wall is set.

Once a sufficient number of truss-wall stud units are set, for example 14-16 linear feet of truss-wall stud units, 2×4 lateral bracing is installed and fastened into optional pre-cut notches in the wall studs. After the lateral bracing is installed, the braced part of the structure can be sheeted with plywood in order to increase lateral shear strength. The process is repeated for every 16 linear feet until the entire perimeter of the structure is laterally braced and sheeted.

The above Detailed Description is intended to be illustrative, and not restrictive. The various embodiments are not necessarily mutually exclusive, as some embodiments can be combined with one or more other embodiments to form new embodiments. For example, the above-described embodiments (and/or aspects thereof) embodiments may be combined, utilized and derived therefrom, such that structural and logical substitutions and changes may be made without departing from the scope of this disclosure. Such embodiments of the inventive subject matter may be referred to herein, individually and/or collectively, by the term "invention" merely for convenience and without intending to voluntarily limit the scope of this application to any single invention or inventive concept if more than one is in fact disclosed. Many other embodiments will be apparent to those of skill in the art upon reviewing the above description. The scope of the invention should, therefore, be determined with reference to the appended claims, along with the full scope of equivalents to which such claims are entitled.

The methods described herein do not have to be executed in the order described, or in any particular order, unless it is otherwise specified that a particular order is required. Moreover, unless otherwise specified, various activities described with respect to the methods identified herein can be executed in repetitive, simultaneous, serial, or parallel fashion.

The terms "a" or "an" are used, as is common in patent documents, to include one or more than one. The term "or" is used to refer to a nonexclusive or, unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The invention claimed is:

1. A method for installing a truss-wall stud unit, the method comprising:

coupling a first bottom plate to a foundation, and coupling a second bottom plate to the foundation, said first and second bottom plates being substantially parallel to each other;

coupling a first hinge bracket to said first bottom plate, and coupling a second hinge bracket to said second bottom plate;

positioning a first partial truss in relation to a second partial truss at the installation site, wherein each of the first and second partial trusses comprise a stud leg portion and a roof truss portion and said roof truss portion of said first partial truss is proximate said roof truss portion of said second partial truss;

coupling a first partial truss with a second partial truss at the installation site to form a truss-wall stud unit wherein the roof truss portion of the first partial truss is coupled to the roof truss portion of the second partial truss using one of the combination of a peak bracket and lower connection plate, or the combination of a standard gusset plate and a bottom chord splice bracket;

coupling the stud leg portion of the first partial truss to said first hinge bracket and coupling the stud leg portion of the second partial truss to said second hinge bracket after the first hinge bracket and the second hinge bracket are coupled to the respective bottom plate the; and hoisting the truss-wall stud unit into a substantially vertical position by applying a hoisting force to the roof truss portions of the truss-wall unit for pivoting the truss-wall stud unit about an axis of rotation defined by the first and second hinge brackets.

2. The method as recited in claim 1, wherein the coupling the stud leg portion of the first partial truss to the first hinge bracket and coupling the stud leg portion of the second partial truss to the second hinge bracket step further comprises bending a portion of each of the hinge brackets and fastening the bent portion of the bracket to the respective stud leg portion of the truss-wall stud unit.

3. The method as recited in claim 1, further comprising coupling an end hinge bracket to each bottom plate near a terminal end of each bottom plate, coupling an end truss-wall stud unit to the bottom plate with the end hinge bracket, and hoisting the end truss-wall stud unit into a substantially vertical position.

4. The method as recited in claim 1, further comprising installing lateral bracing within the truss-wall studs.

5. The method as recited in claim 1, further comprising threading a hoist cable through a passage in one of a second peak bracket or a second bottom chord splice plate of a second truss-wall stud unit that was previously raised into a substantially vertical position and connecting the hoist cable to one of the peak bracket or the bottom chord splice plate of the truss-wall stud unit after said threading step and prior to said hoisting step.

* * * * *